US011549235B2

(12) United States Patent
Wei

(10) Patent No.: US 11,549,235 B2
(45) Date of Patent: Jan. 10, 2023

(54) SYSTEM AND METHOD FOR CONTROLLING OPERATION OF A MACHINE

(71) Applicant: Caterpillar Global Mining LLC, Tucson, AZ (US)

(72) Inventor: Mo Wei, Dunlap, IL (US)

(73) Assignee: Caterpillar Global Mining LLC, Tucson, AZ (US)

( * ) Notice: Subject to any disclaimer, the term of this patent is extended or adjusted under 35 U.S.C. 154(b) by 354 days.

(21) Appl. No.: 16/559,061

(22) Filed: Sep. 3, 2019

(65) Prior Publication Data

US 2021/0062470 A1 Mar. 4, 2021

(51) Int. Cl.
*E02F 9/20* (2006.01)
*E02F 3/43* (2006.01)

(52) U.S. Cl.
CPC ..... *E02F 9/2029* (2013.01); *E02F 3/43* (2013.01); *E02F 9/2045* (2013.01)

(58) Field of Classification Search
CPC ... E02F 3/43; E02F 3/841; E02F 3/844; E02F 9/2029; E02F 9/2045; E02F 9/264; E02F 9/261
USPC ..... 701/50
See application file for complete search history.

(56) References Cited

U.S. PATENT DOCUMENTS 5,950,141 A 9/1999 Yamamoto et al.
8,583,326 B2 * 11/2013 Collins ..... G05D 1/0219 701/41
9,228,315 B2 1/2016 Edara et al.
9,388,550 B2 7/2016 Wei et al.
2013/0081831 A1 * 4/2013 Hayashi ..... E02F 3/847 172/4.5
2014/0012404 A1 1/2014 Taylor et al.
2015/0319913 A1 * 11/2015 Foster ..... G05D 1/0217 701/26
2016/0077513 A1 * 3/2016 Wei ..... G05D 1/0217 700/114
2018/0245308 A1 * 8/2018 Ready-Campbell ..... G05D 1/0231
2022/0178114 A1 * 6/2022 Takahama ..... G01C 15/00

* cited by examiner

*Primary Examiner* — Geepy Pe
*Assistant Examiner* — Sean Patrick Reidy
(74) *Attorney, Agent, or Firm* — Xsensus LLC

(57) ABSTRACT

A system to control operation of a machine having a ground-engaging work implement for moving material about a worksite include a controller configured to determine a feasible target profile for the work implement to engage material. The feasible target profile may include a preload segment, a cut segment, and a loading segment. The controller determines a feasible prospective cut segment from a plurality of prospective cut segments. The controller generates a prospective preloading segment and a prospective loading segment associated with the feasible prospective cut profile. Position points associated with the loading segment are extracted and the controller determines if the ground-engaging work implement will align with the plurality of position points. The controller may also determine whether the load volume for the prospective cut segment is efficient.

17 Claims, 7 Drawing Sheets

SYSTEM AND METHOD FOR CONTROLLING OPERATION OF A MACHINE

TECHNICAL FIELD

This patent disclosure relates generally to controlling a machine to develop a worksite by displacing material with a ground-engaging work implement, and, more particularly to determining a loading profile by which to guide the work implement as it cuts and loads with material.

BACKGROUND

Machines such as dozers, motor graders, wheel loaders and the like are used to perform tasks such as moving material about a worksite like a mine, quarry, construction site, or the like. The machines may operate autonomously, semi-autonomously, or manually. In autonomous operation, the machine is operated according to a predetermined work plan without the assistance of a human operator, while in semi-autonomous operation, a human operator who may be present on the machine or may be at a remote location may be responsible for directing the machine to perform certain tasks. In manual operation, the operator is generally responsible for directing all tasks performed by the machine. To assist in operation, the machine may include an electronic control unit, control module, or controller that is responsive to and capable of processing instructions and commands for performing various tasks associated with the work plan.

One common operation conducted by machines designed in accordance with the disclosure involves removing overburden from a worksite to access more desirable materials, such as coal or ore, located underneath the overburden. The machine may include a ground-engaging work implement such as a blade for pushing the material to a different location. A plurality of machines may operate in conjunction with each other making multiple passes over the worksite to displace the material. Making multiple passes with the machine results in the formation of slots or channels in the worksite as the material is removed, and when a plurality of machines are operating together, multiple parallel slots may be formed.

To improve efficiency, it is desirable that the work implement is controlled to move a significant quantity of material per pass without overburdening the machine. U.S. Pat. No. 9,388,550 (the '550 patent), assigned to the present applicant, discloses a system and methodology for the autonomous control of the machine to alter the terrain of the worksite. The '550 patent describes that the controller can conduct various analytical steps to arrive at a desired loading profile which guides the work implement as it engages the ground. The present application is directed to related, but different, methods for determining a loading profile by which operation of the machine may be controlled.

SUMMARY

The disclosure describes, in one aspect, a system for controlling a machine having a ground-engaging work implement to move material according to a target profile that includes at least a preloading segment, a cut segment, and a loading segment. The system includes data storage to store computer processable data including machine dimensional data, machine operational data, and a presented topography of a worksite. The system also includes a position sensing system for determining a current machine position/orientation assessment. A controller included with the system is configured to generate a feasible target profile by deciding the feasibility of a prospective cut segment from among a plurality of prospective cut segments based on the current machine position/orientation assessment, the machine dimensional data, the machine operational data, and the presented topography. The controller the generates a prospective preload segment and a prospective loading segment associated with the prospective cut segment. The controller extracts a plurality of position points associated with the prospective loading segment and decides the feasibility of the prospective loading segment by determining if the ground-engaging work implement will align with the position points associated with the prospective loading segment.

In another aspect, the disclosure describes a method of generating a target profile for a machine having a ground-engaging work implement to move material about a worksite. The target profile typically has a preloading segment, a cut segment, and a loading segment. In accordance with the method, there is stored in data storage machine dimensional data related to dimensions of the machine, machine operational data related to operation of the machine, and a presented topography of the work site. The method determines a current machine position/orientation assessment of the machine at the worksite. The method thereafter decides on the feasibility of a prospective cut segment from a plurality of prospective cut segments based on the current machine position/orientation assessment, the machine dimensional data, the machine operational data, and the presented topography by determining if the ground-engaging work implement will be positioned to intersect a cut point associated with the prospective cut segment. The method calculates a load volume for the prospective cut segment that is indicative of a quantity of material moved by a pass of the machine at the worksite. The method may decide if the load volume is efficient or not. The method also generates a prospective preload segment and a prospective loading segment associated with the prospective cut segment and extracts a plurality of position points associated with the prospective loading segment. The method then determines if the prospective loading segment is feasible by determining if the ground-engaging work implement will align with the plurality of position points.

In yet another aspect, the disclosure describes a machine including a prime mover for producing power, a ground-engaging work implement for moving material about a worksite, a position sensing system for determining a current machine position/orientation assessment of the machine at the worksite, and data storage for storing computer processable data related to machine dimensional data, machine operational data, and a presented topography of the worksite. The machine also includes a controller configured to generate a feasible target profile. To generate the feasible target profile, the controller decides whether a prospective cut segment from among a plurality of prospective cut segments is feasible based on the current machine position/orientation assessment, the machine dimensional data, the machine operational data, and the presented topography. The controller calculates a load volume for the prospective cut segment that is indicative of a quantity of material to be moved by the machine during the feasible target profile. The controller decides if the load volume is efficient and, if so, generates a prospective preload segment and a prospective loading segment associated with the prospective cut segment. The controller can extract a plurality of position points associated with the prospective loading segment and decides the feasibility of the prospective loading segment by determining if the ground-engaging work implement will align with the position points.

DETAILED DESCRIPTION

Figure 1:
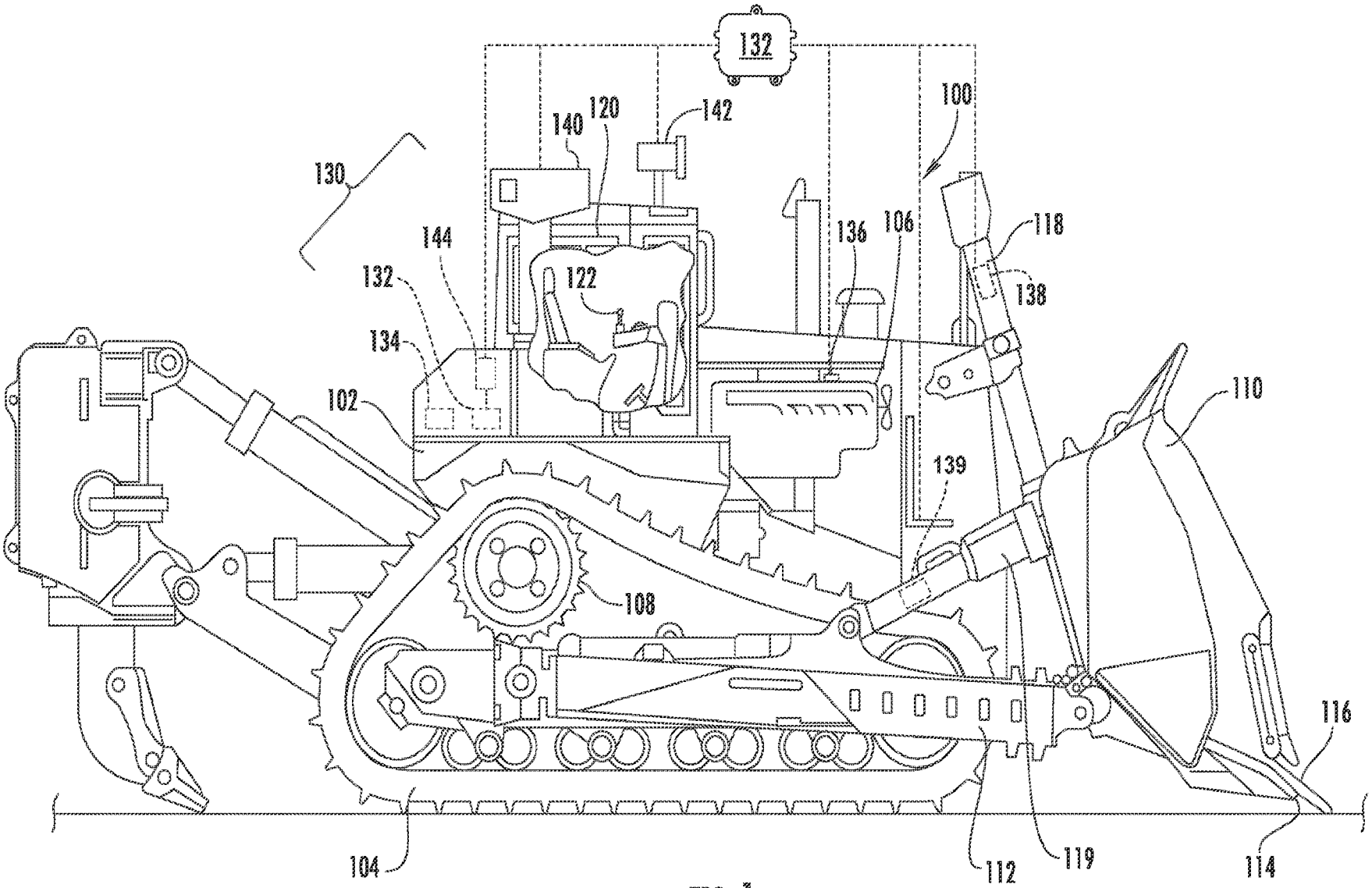
FIG. 1 is a side elevational view of a machine that, in accordance with an aspect of the disclosure, may have a ground-engaging work implement in the form of a blade to displace material from a worksite.

Now referring to the drawings, wherein like reference numbers refer to like elements, there is illustrated an embodiment of a machine 100 for moving material about a worksite in the form of a dozer. However, it should be appreciated that aspects of the disclosure may be applicable to other types of machines such as a motor grader, a wheeler loader, or any other suitable type of machine for moving material. The machine 100 may include a frame 102 that is supported on one or more continuous tracks 104 for propelling the machine 100 about the worksite; however, in other embodiments, the machine 100 may be supported on wheels or may utilize other suitable forms of propulsion. To generate operational power, the machine 100 can include a prime mover such as an internal combustion engine 106 that can combust a hydrocarbon-based fuel like diesel and convert the latent energy associated with the fuel to a mechanical force. The internal combustion engine 106 may interact with the continuous tracks 104 through a rotatable drive sprocket 108 that causes the tracks to move in a continuous loop with respect to the ground. In another embodiment, the machine 100 can be configured to operate on hydrostatic power, electrical power, or as a hybrid using a combination of different sources of power.

To move material about the worksite, the machine 100 can include a ground-engaging work implement such as a blade 110 configured to push material. The blade 110 can be pivotally connected to the frame 102 by implement arms 112 on each side of the machine 100 and can include a blade tip 114 dispose along its lower edge to cut into the surface of the worksite and cut material therefrom. The blade 110 may include a plurality of teeth 116 protruding along the blade tip 114 to facilitate penetrating the ground at the worksite, especially if material is compacted or hardened. It can be appreciated that when the blade 110 is lowered to the ground, forward operation of the continuous tracks 104 causes the machine 100 to push material about the worksite. To vertically raise and lower the blade 110 with respect to the ground, the machine 100 includes one or more first hydraulic cylinders 118 disposed on either side of the frame 102 that can be extended and retracted resulting in responsive movement of the blade 110. In addition, the machine 100 may include a set of second hydraulic cylinders 119 operatively arranged on the frame 102 to alter the angular pitch of the blade tip 114 with respect to the ground. To actuate the first and second hydraulic cylinders 118, 119, they may be operatively associated with a hydraulic system that supplies pressurized fluid to the cylinders. The internal combustion engine 106 may provide power for the pumps associated with the hydraulic system.

The machine 100 can be configured for autonomous, semi-autonomous, or manual operation. During autonomous operation, the machine 100 may utilize various sensors and controls to conduct operations without the need for human operator input. As an example, a haul or a load truck that automatically follows a path from one location to another and dumps its load at the end is referred to be in autonomous operation. In semi-autonomous operation, a human operator either on board the machine or at a remote location can be responsible for conducting some tasks and providing some operational inputs while other tasks are conducted automatically. For example, a haul or load truck may automatically travel from one location to the next, but requires an operator to complete the dumping operation. In manual operation, a human operator is responsible for performing a majority of the tasks associated with the machine 100. To accommodate a human operator during manual operation, the machine 100 can include an operator's station 120 disposed on the frame 102 in a location to provide sufficient visibility about the worksite. The operator's station 120 can include one or more inputs 122 such as joysticks, steering columns or wheels, pedals, and the like through which the operator can direct operation of the machine 100, including steering functions and manipulation of the blade 110 and other work implements associated with the machine. Various other dials and instruments can be included in the operator's station 120 for the operator to interact with the machine 100.

To assist in controlled operation, the machine 100 may be associated with a control system 130 that may include an electronic control unit, control module, or controller 132 configured to process electronic signals. The controller 132, and other components and/or functionality associated with the control system 130, may be located entirely onboard, entirely or partially offboard, or any variation thereof. The controller 132 is adapted to monitor various operating parameters and to responsively regulate various variables and functions affecting operation of the machine 100. The controller 132 can include one or more microprocessors, application specific integrated circuits ("ASIC"), field programmable arrays, or other appropriate electronic circuitry for processing signals and commands for operation of the machine 100. The controller 132 can be configured to execute various functions, steps, routines, data maps, data tables, charts and the like. Although the controller 132 in FIG. 1 is illustrated as a single discrete unit, the controller 132 and its functionality may be distributed among a plurality of distinct and separate components.

To store the functions, routines, data maps, data tables, charts and the like, and to store the computer executable software code providing programming instructions for execution of programs and applications and for interpretation and manipulation of data, the controller 132 can be operatively associated with data storage 134. The data storage 134 can be in the form of memory, such as random access memory or read only memory, or can be a more permanent storage device such as a hard drive. The data storage 134 can be repetitively read from and written to, and provides for storage of data and information utilized by the controller 132 for executing the functions and tasks of the machine 100.

To receive operational data and to send control commands, the controller 132 can communicate with various sensors and controls disposed about the machine 100 and that are operatively associated with the control system 130. Communication between the controller 132 and the other components associated with the control system 130 can be established by sending and receiving digital or analog signals across communication channels such as communication lines or communication busses. The various communication channels are indicated in dashed lines for illustration purposes.

For example, to monitor and regulate various operating parameters associated with engine 106 such as engine speed and/or output torque, the control system 130 can include an engine sensor and control 136 that can, for example, adjust the quantity of fuel and/or air directed to the engine 106 to adjust its speed and/or output torque. To vertically raise or lower the blade 110 with respect to the ground, the control system 130 can communicate with a first hydraulic control 138 operatively associated with the set of first hydraulic cylinders 118. The hydraulic control 138 can be an electromechanical device such as a solenoid that operates valves associated with the first hydraulic cylinders 118 to selectively direct hydraulic fluid to extend and retract a piston slidably disposed in the cylinder. A second hydraulic control 139 can be operatively associated with the second hydraulic cylinders 119 to adjust the pitch of the blade tip 114. In addition to controlling the selective actuation of the first and second hydraulic cylinders 118, 119, the first and second hydraulic controls 138, 139 can be configured to determine the position of the blade 110 relative to the frame 102 of the machine 100. To determine the position of the blade 110, the first and second hydraulic controls 138, 139 can include or can be operatively associated with position sensors that may utilize any suitable operative principle, such as rotatory sensors that measure angular position of pivot joints, pressure sensors that sense fluid pressure in the cylinders that is used to indicate relative position, magnetic sensors, optical sensors, or the like.

In the embodiment where the machine 100 is configured for autonomous or semi-autonomous operation, the control system 130 can include a transmitter/receiver 140 for sending and receiving signals to remotely communicate with an off-board location having additional equipment for operation of the machine 100, or the transmitter/receiver 140 can enable communication with other machines operating at the worksite. The transmitter/receiver 140 may utilize any suitable form of telecommunication or data transmission including, for example, radio frequency (RF) signals. The control system 130 can include additional equipment to facilitate autonomous or semi-autonomous operation such as a camera 142 disposed on the operator's station 120 or other location to provide visibility regarding the machine location at the worksite. Visual captures from the camera 142 can be transmitted to a remote location from where the machine 100 may be controlled.

To determine the orientation of the machine 100 with respect to the worksite, the control system 130 may be operatively associated with a position sensing system 144. The position sensing system 144 can be configured to determine the location or position of the machine 100 with respect to the worksite. The location or position of the machine 100 can be determined based on any suitable local or global coordinate system. The position sensing system 144 can include any suitable position sensitive devices operating on any suitable principles such as, for example, gyroscopes and optical sensitive devices. In various embodiments, the position sensing system 144 can utilize a global positioning satellite system to determine the location of the machine 100, or the position sensing system 144 may utilize other technologies like radar, lidar, or similar technologies to sense information about the worksite and the relative position of the machine 100. The position sensing system 144 may also be able to determine the orientation of the machine 100 in terms of yaw, pitch, roll, tilt, and the like. The position sensing system 144 may use such information to determine a slope or inclination of the machine 100 on the worksite. The position sensing system 144 may also be configured to determine velocity or ground speed of the machine 100, for example, by monitoring the continuous tracks 104 that propel the machine 100 about the worksite 150. The position sensing system 144 may use the orientation and velocity information to determine a heading and an intended course of the machine 100 on the worksite.

Figure 2:
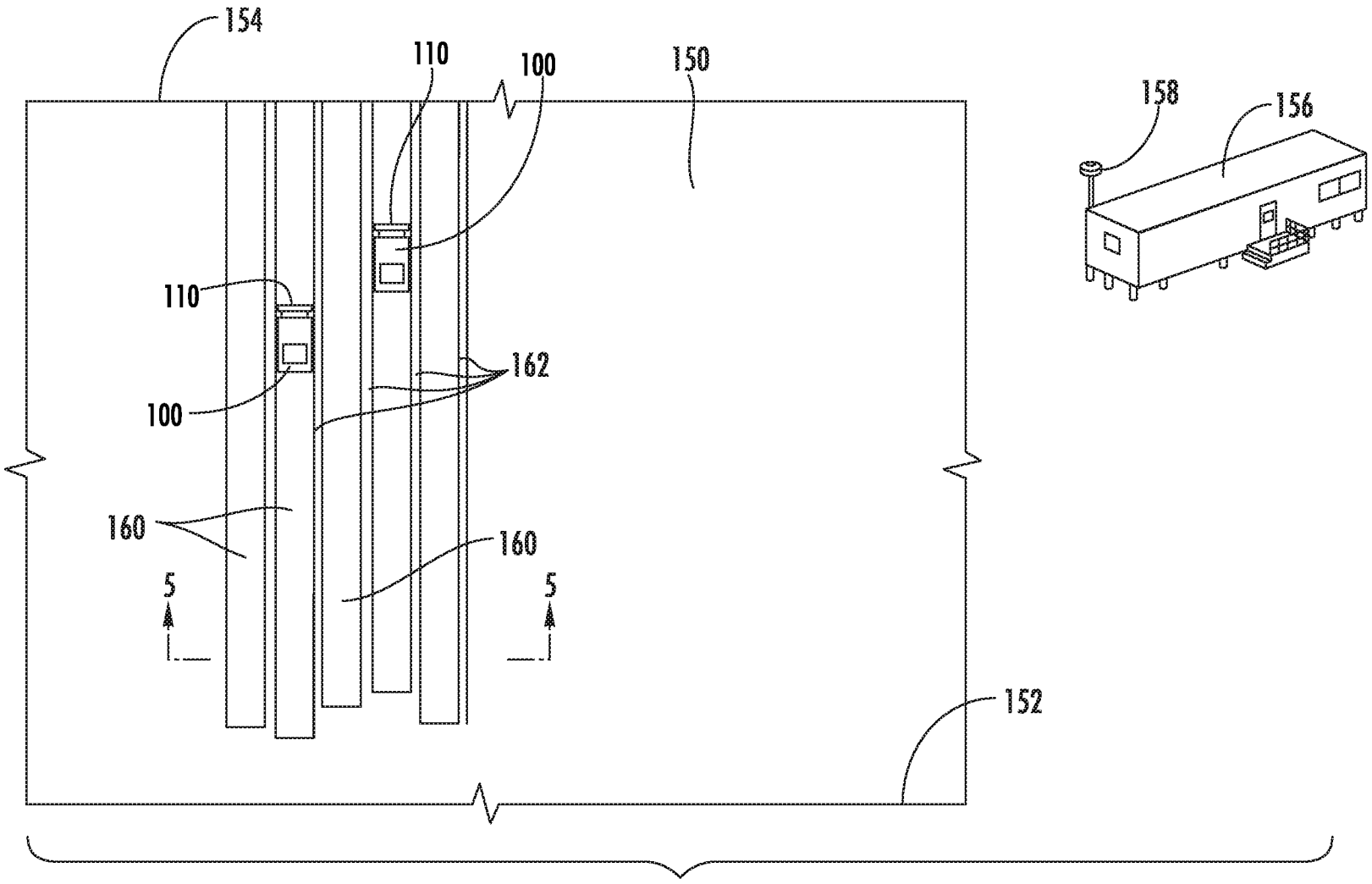
FIG. 2 is a schematic view of a worksite such as a mine in which one or more machines may be utilized to move material from one location to another by making multiple passes to form slots across the worksite, a procedure that may be referred to as "slot dozing."

Referring to FIG. 2, there is illustrated a representative worksite 150 in accordance with the disclosure at which machines 100 of the type described herein are utilized. The worksite 150 may be an open-pit mining operation in which overburden that lies above the material of interest, such as a coal seam or ore deposit, is removed. However, in various embodiments, the worksite 150 may be associated with other operations such as a landfill, a quarry, a construction site, or another physical location where it is desirable to move or displace earthen materials. Tasks associated with the worksite 150 include dozing, grading, leveling, or any other type of operation that alters the existing terrain of the worksite 150. The worksite 150 may have a high wall 152 at one end of the worksite 150 and a dump location 154, which may be a crest, a ridge, an embankment or other change in elevation, at the opposite end of the worksite 150. The high wall 152 will typically be located at a higher elevation than the dump location 154 so that the machine 100 travels downhill to displace material. Material is generally moved from the high wall 152 to the dump location 154 where the material is dispersed. In the embodiments in which the machine 100 is operated autonomously or semi-autonomously, a workstation 156 can be located on the worksite 150 at a fixed location. The workstation 156 may be a building or the like that can accommodate one or more computers used to regulate and manage operation of the worksite 150. To communicate with the machines 100 and personnel at worksite 150, the workstation 156 can include a transmitter/receiver 158 located at an appropriate location to increase its exposure to the physical worksite 150.

In operation, one or more machines 100 can be operated autonomously, semi-autonomously, or manually to travel back and forth between the high wall 152 and the dump location 154 where the material is displaced, dumped, or spread out. As the machine 100 travels from the high wall 152 toward the dump location 154, the blade 110 is lowered to contact the surface of the worksite 150 to remove a layer of material. In an embodiment, the machine 100 can be operated to repetitively travel back and forth been the high wall 152 and the dump location 154 in a straight linear manner so that a linear channel or slot 160 is formed by the machine 100. Moreover, when multiple machines 100 are operating, a plurality of slots 160 can be formed parallel to each other. Each time the machine 100 travels the length of the slot 160, an additional layer of material will be removed. As the machine 100 travels from proximate the dump location 154 back along the slot 160 to the high wall 152, the blade 110 may be vertically raised with respect to the material surface to disengage with the worksite 150. In an embodiment, a small amount of material may be deposited as walls or berms 162 between adjacent slots 160 to reduce spillage and increase the efficiency of the material moving operation. The process of moving material through slots 160 while utilizing berms 162 to increase the efficiency of the process is sometimes referred to as "slot dozing."

Figure 3:
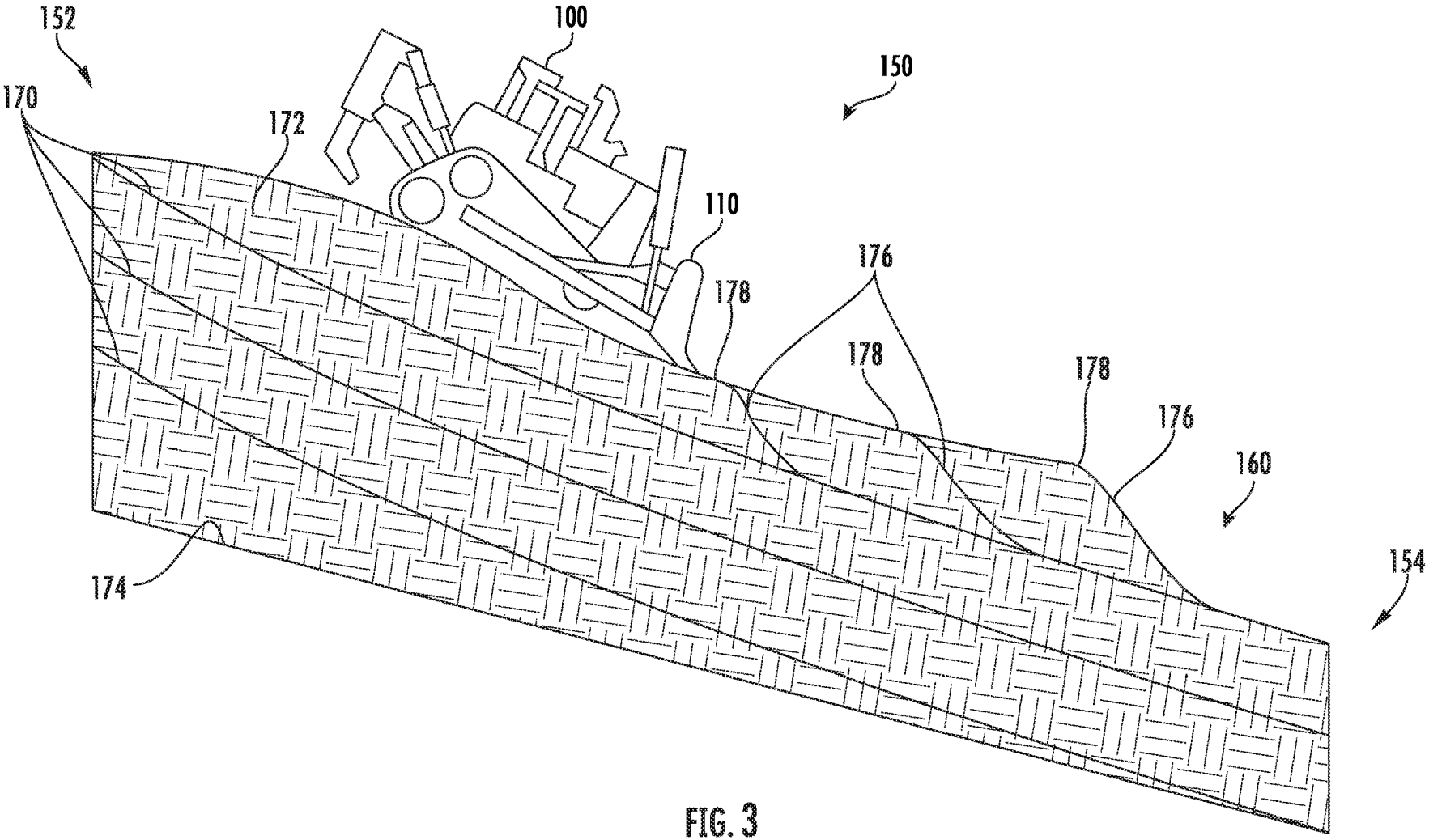
FIG. 3 is a schematic diagram of a cross-section of the worksite from which material is removed by a machine making multiple passes and cuts to form a slot in the worksite.

Referring to FIG. 3, in an embodiment, each slot 160 may be formed by removing material from the worksite 150 by making multiple linear passes 170 made over the material surface 172 of the worksite 150 with the machine 100 until a desired target plane or final design plane 174 for the worksite is achieved. During each pass 170, the blade 110 of the machine 100 engages the material surface 172 in a cut 176 in which the blade 110 is vertically lowered to penetrate the surface and dig into the material. Each cut 176 is initiated at a cut location or cut point 178 along the material surface 172 and moves toward the final design plane 174 pushing or displacing the material forward toward the dump location 154 or other location at which the material may be dispersed. Once dispersed, the machine 100 may backtrack along the slot 160 to make another pass 170 at a new cut point 178 associated with a new cut 176 into the material surface 172. Development of the worksite 150 may involve a plurality of cuts 176 at different cut points 178 that are spaced apart lengthwise along the slot 160. Moreover, the machine 100 may make multiple passes 170 within the slot 160 between the high wall 152 and the dump location 154, with each pass 170 occurring at a different vertical elevation within the slot 160. Hence, the topography of the worksite 150 is gradually changed by material removal until the final design plane 174 is achieved.

Figure 4:
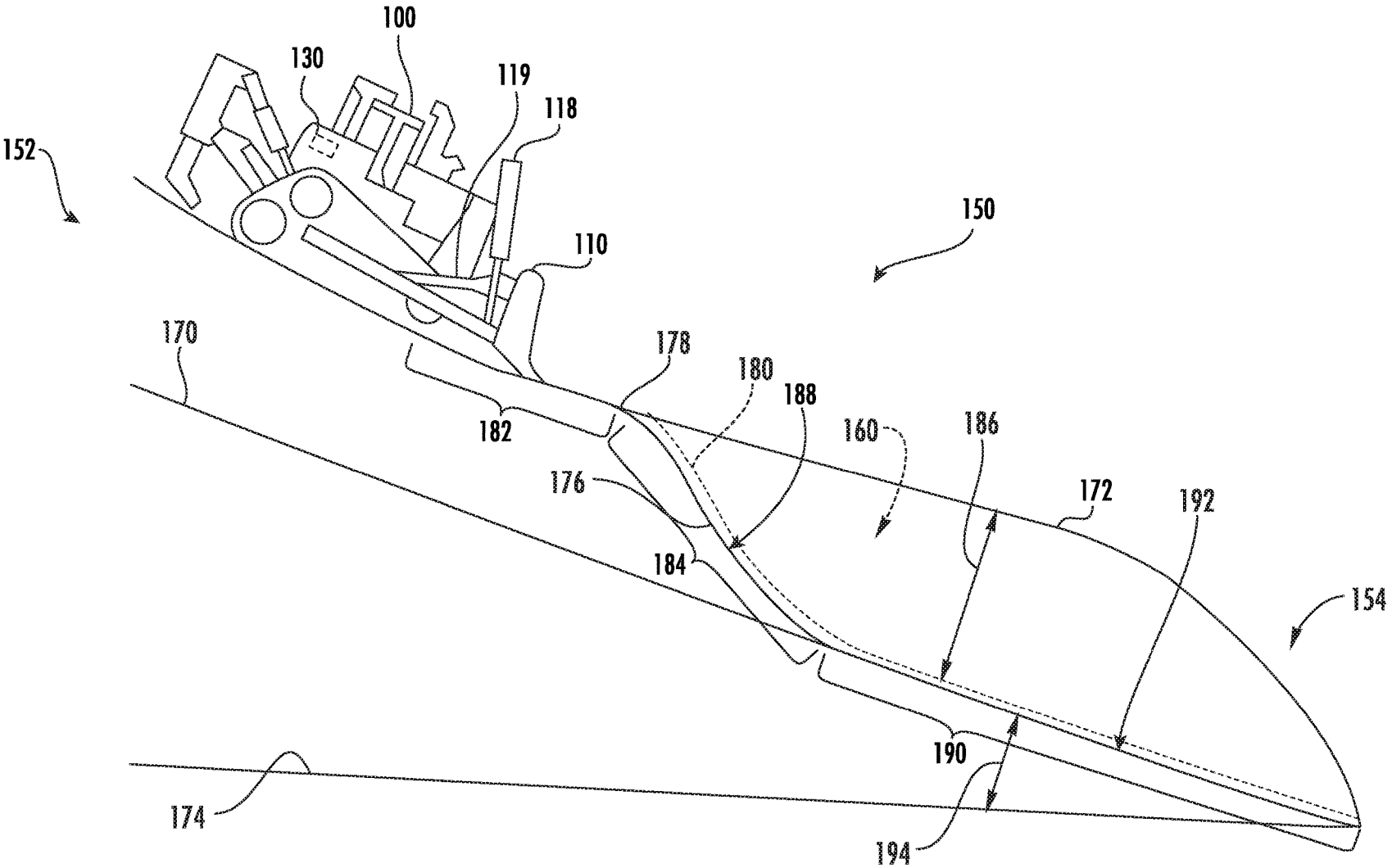
FIG. 4 is another schematic diagram of a cross-section of the worksite illustrating different segments of a generated target profile by which the machine cuts into and displaces material during the passes that form the slots.

Referring to FIG. 4, each pass 170 made by the machine 100 may include a plurality of profiles in which the blade 110 is directed into the material surface 172 to make the cut 176 and then is further guided to move or displace material forward. The profiles, which may also be referred to as loading curves, represent the vertical and/or longitudinal motion of the blade 110 through the material of the worksite 150 when forming the slots 160. Furthermore, the control system 130 associated with the machine 100 may be configured to determine or generate a target profile 180 (depicted in dashed lines) to guide or direct the blade 110 from the cut point 178 to the dump location 154. The target profiles 180 may be generated to optimize material removal while accounting for physical characteristics and/or limitations of the machine 100 such as the physical dimensions of the blade 110 or power and/or loading constraints limiting the volume of material that the machine 100 can move per pass 170.

Each target profile 180 may include a series of portions or segments as the blade 110 moves toward and engages the material surface 172 at the cut point 178 and progresses toward the dump location 154. The first segment may be a preload segment 182 that occurs physically before and temporally prior the cut point 178 whereat the blade 110 engages the material surface 172 to make the cut 176. The preload segment 182 may be characterized by positioning of the blade 110, which may be vertically elevated from the material surface 172 at the time, at the proper orientation and/or angle of attack with respect to the material surface 172 to intersect at the cut point 178. The preload segment 182 may occur as the machine 100 begins forward motion along the slot 160, although in some instances repositioning of the blade 110 can occur while the machine 100 backs up within the slot 160.

The second segment may be referred to as the cut segment 184, and may be characterized by engagement of the blade 110 with the material surface 172 at the cut point 178, and continued positioning of the blade 110 to lower into or descend into the material. The first and second sets of hydraulic cylinders 118, 119 on the machine 100 may be appropriately actuated to guide or direct the blade 110 into the worksite material during the cut 176, for example, by vertically lowering the blade or altering its pitch with respect to the material surface 172. The cut segment 184 represents the portion of the target profile 180 at which the blade 110 is initially loaded with material. The cut segment 184 may continue until the blade 110 has penetrated or reached a desired vertical cut depth 186 from the material surface 172 for the target profile 180. The cut depth 186 may be determined in part based on the machine dimensions, material characteristics such as whether the material is compact or soft, and/or a predetermined volume or mass of material the machine 100 can displace. The cut segment 184 results in a cut surface 188 being formed into the slot 160 that, if the cut 176 is conducted correctly, can have the desired contour, grade, or slope. The resulting cut surface 188 may have any desired shape including linear, symmetrical, or asymmetrical.

The third segment may be referred to as a loading segment 190 and may extend from the termination of the cut segment 184 along the slot 160 to the dump location 154. The loading segment 190 may be characterized by leveling of the blade 110 upon reaching the cut depth 186 and the continual loading of the blade 110 as the machine 100 travels forward in the slot 160. The loading segment 190 may have any configuration but typically is linear and sloped downward so that forward movement of the machine 100 and the material can be assisted by gravity. The downward configuration of the loading segment 190 toward the dump location 154 results in a carry surface 192 over which the material is pushed by the machine 100. The downward slope or grade of the carry surface 192, as indicated by reference angle 194, may be generally similar to that of the overall worksite 150 so that the cut depth 186 for a particular pass 170 is maintained. In some instances, the reference angle 194 of the carry surface 192 can be defined relative to a gravity reference or relative to the final design plane 174. The length of the carry surface 192 to the dump location 154 can be determined in part based on the volume or mass of material that is estimated will be moved during the loading segment 190.

As indicated, the target profile 180 generated by the control system 130 associated with the machine 100 can be optimized for material volume and efficiency based on the capabilities of the machine 100 and characteristics of the material at the worksite 150. However, particular worksites may present topographies or terrains that may impede execution of the determined target profile as determined by the control system 130. For example, the topography may be too uneven or rough, especially at the start of a slot dozing operation, such that the kinematics of the machine 100 limits or prevents the machine from executing the target profile 180. By way of example, the blade 110 of the machine 100 may not be capable of following the course of the target profile 180 because of limitations on the vertical maneuverability of the blade 110. By way of further example, the orientation of the machine 100 within the slot 160 may be such that the blade 110 will not be correctly positioned relative to the cut point 178 to execute the cut 176. Thus, a particular target profile 180 may be feasible or infeasible given the particular topography of the worksite 150.

Figure 5:
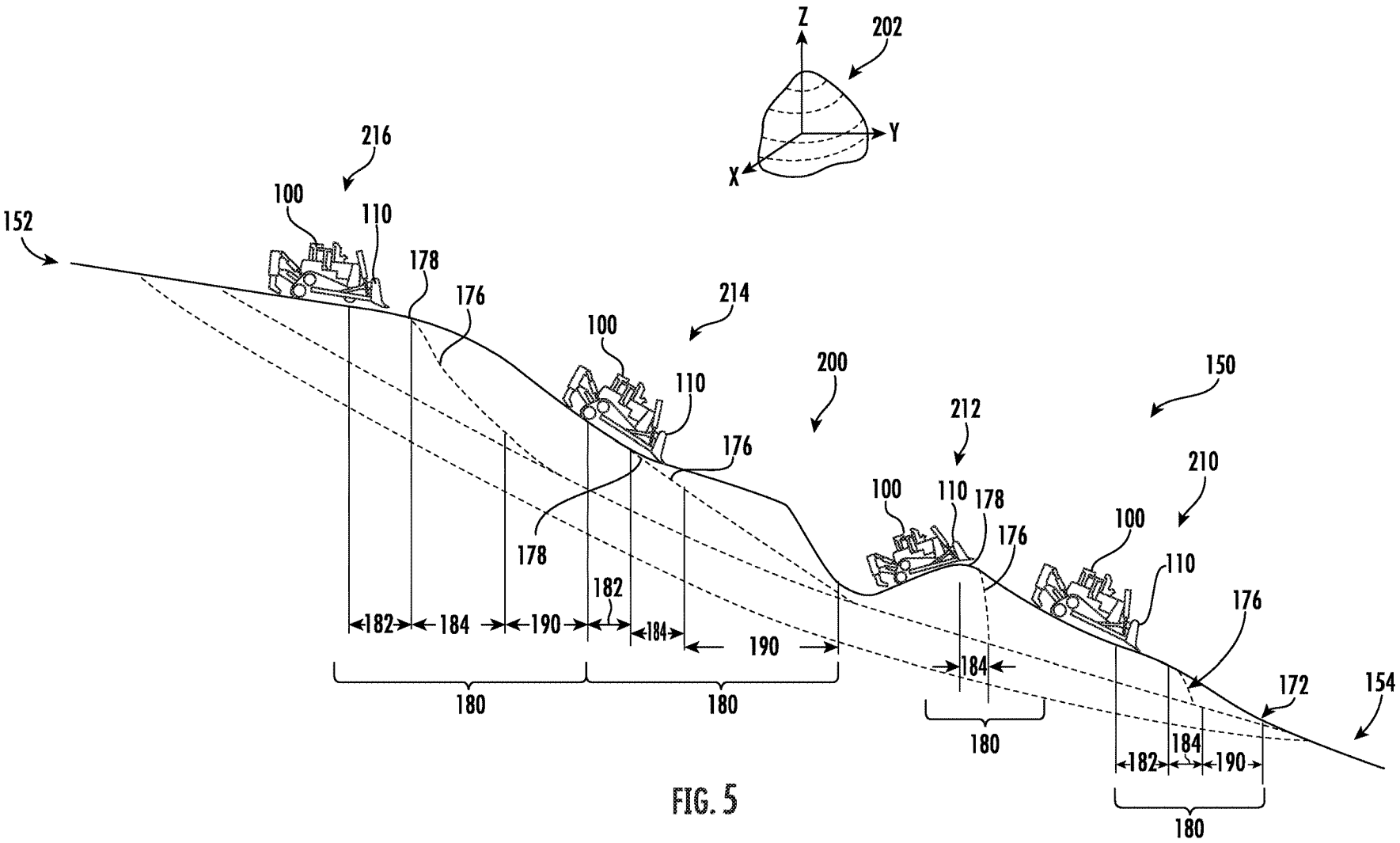
FIG. 5 is another schematic diagram of a worksite depicting various feasible and infeasible target profiles and cut points that the machine may attempt to perform to engage the ground in accordance with the disclosure.

Referring to FIG. 5, there is illustrated various feasible and infeasible target profiles for a presented topography 200 of a worksite 150. The three-dimensional geometry of the presented topography 200, including slopes, elevations, grades, and contours, may be predetermined by direct or remote surveying, and may be stored as a three-dimensional, digitally readable, topographic map 202. A first infeasible scenario 210, for example, may occur when the machine 100 is sufficiently positioned and oriented on the material surface 172 during the preload segment 182 of the target profile 180 so that the blade 110 will be correctly positioned to intersect the cut point 178 and execute the cut 176. However, for the presented topography 200, it may be determined that the volume of material that may be removed by the first infeasible scenario 210 is insufficient from an efficiency perspective, for example, because the loading segment 190 to the dump location 154 associated with the first infeasible scenario 210 is too short. The efficiency or inefficiency of a particular target profile 180 may be determined based on time or fuel considerations.

A second infeasible scenario 212 may occur when the machine 100 is improperly oriented on the material surface 172 such that the blade 110 will not be positioned to intersect the cut point 178 for the target profile 180. For example, the local slope or gradient of the particular topography 200 may be such that the blade 110 will be directed away from the cut point 178 at the start of the cut segment 184 associated with the cut 176. In such an example, the local terrain may be inclined upwardly despite the overall downward slope of the worksite. By way of another example, the slope or grade of the resulting cut segment 184 of the desired cut 176 may be such that the machine 100 could be susceptible to slipping or tipping. A third infeasible scenario 214 may occur when the local slope or gradient of the presented topography 200 allows for the machine 100 to perform the cut 176, and the resulting cut segment 184 and loading segment 190 allows for efficient material removal, but the preload segment 182 will not adequately position the machine 100 to execute the cut 176. For example, the generated target profile 180 may result in a preload segment 182 in which the machine 100 has physically passed the cut point 178, or has insufficient time to orientate the blade 110 to intersect the cut point 178.

A feasible scenario 216 for the target profile 180 may occur where the machine 100 is properly oriented and positioned on the material surface 172 such that the preload segment 182 of the target profile 180 enables the machine 100 to position the blade 110 to intersect the cut point 178 and execute the cut 176. Moreover, the resulting local slope or gradient of the cut 176 and the length or dimension of the loading segment 190 may be such that the machine 100 will remove or displace an adequate volume of material without subjecting the machine to stalling or tipping. Hence, the target profile 180 is the feasible scenario 216 based on consideration of the kinematics and capabilities of the machine 100 and efficiency considerations.

In accordance with the disclosure, a target profile 180 for conducting a slot-forming cut 176 at a worksite 150 may be generated and its feasibility or infeasibility assessed based on a plurality of factors associated with the kinematics and capabilities of the machine 100 and the presented topography 200 of the worksite 150. The target profile 180 may be further generated to optimize efficient material removal from the worksite 150 during each pass 170. The control system 130 associated with the machine 100 may generate the target profile 180, and the target profile may be in the form of computer executable instructions or code for performing tasks, such as controlled movement of the blade 110, necessary for the machine 100 to execute the target profile 180. The generated target profile 180 may be used with machines 100 operating autonomously, semi-autonomously, or manually.

In a broad aspect, the target profile 180 may be assessed based on the feasibility or infeasibility of different segments or portions of the target profile 180, the aspects or characteristics of those segments, and the desired results or outcomes associated with the segments. By way of example, the target profile 180 may be distinguished or separated into a preload segment 182, a cut segment 184, and a loading segment 190 as described above. The feasibility of the different segments may be individually assessed, and the results of the assessments may be compared, balanced, and or combined, to determine the feasibility of the overall target profile 180. The individual assessments of the segments may occur sequentially, concurrently, or in an ordered arrangement to inform subsequent segment assessments.

In an embodiment, the feasibility of the cut segment 184 may be assessed initially or first, for example, based on whether the machine 100 is adequately oriented and situated so that the blade 110 will be positioned to intersect the cut point 178. The cut angle or cut slope may also be considered and its possible effects on the machine 100 and whether the machine can successfully execute the cut 176. The preload segment 182 and the orientation of the machine 100 at that location and/or time may be considered during this assessment. If the cut segment 184 is feasible, the quantity or volume of material that may be removed by the cut 176 and subsequent loading segment 190 is considered to determine the efficiency of the target profile 180. The feasibility or infeasibility of preload segment 182 and loading segment 190 may be evaluated by, for example, dividing those segments into individual position points and evaluating whether the machine 100 is capable of positioning the blade 110 at those position points to achieve the target profile 180. Moreover, the assessments may be conducted iteratively resulting in continuous, real time, overall determinations of the feasibility of the target profile 180.

INDUSTRIAL APPLICABILITY

Figure 6:
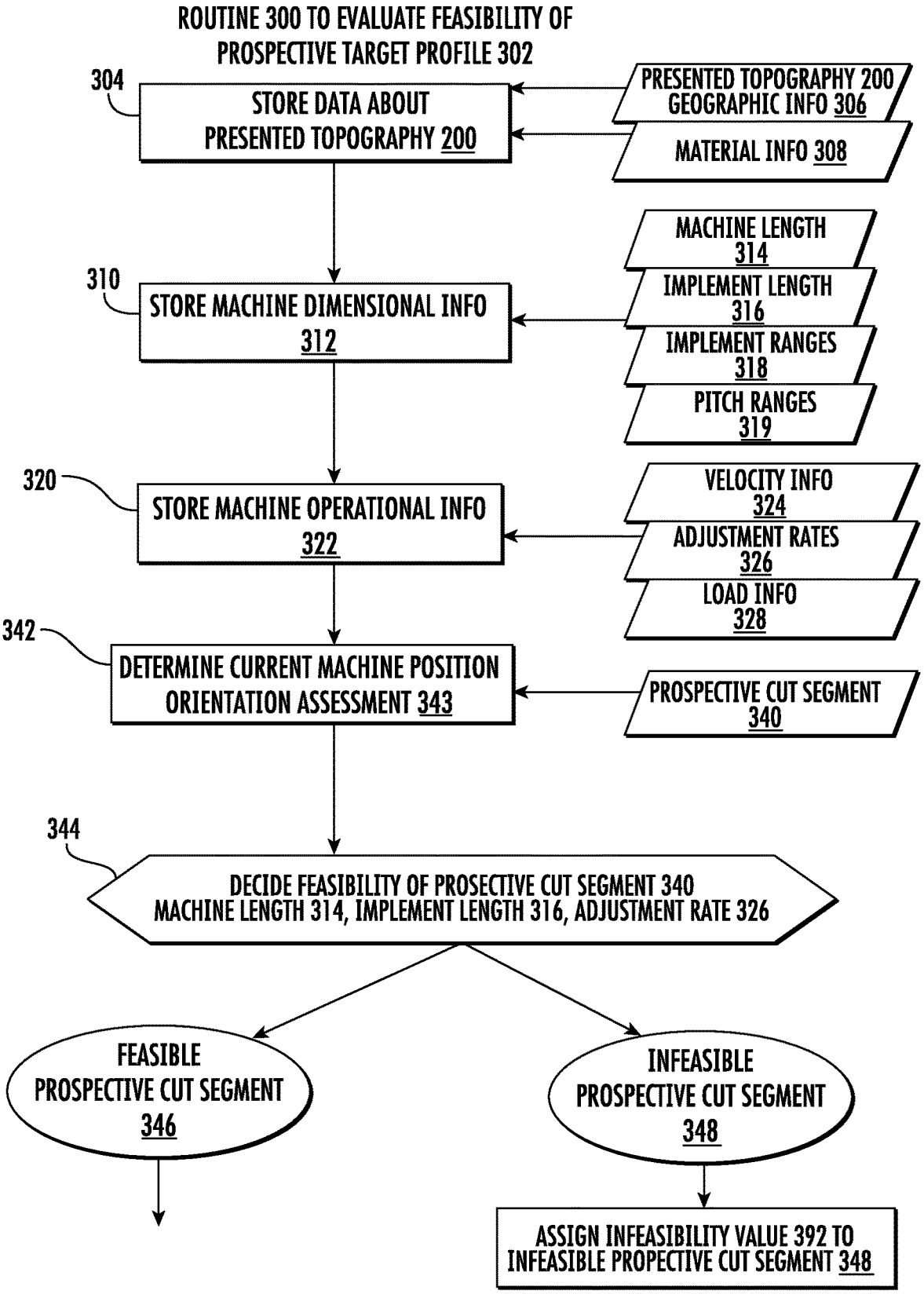
FIG. 6 is flowchart for generating a load profile for the machine to conduct a pass over the worksite in accordance with the disclosure.
Figure 6:
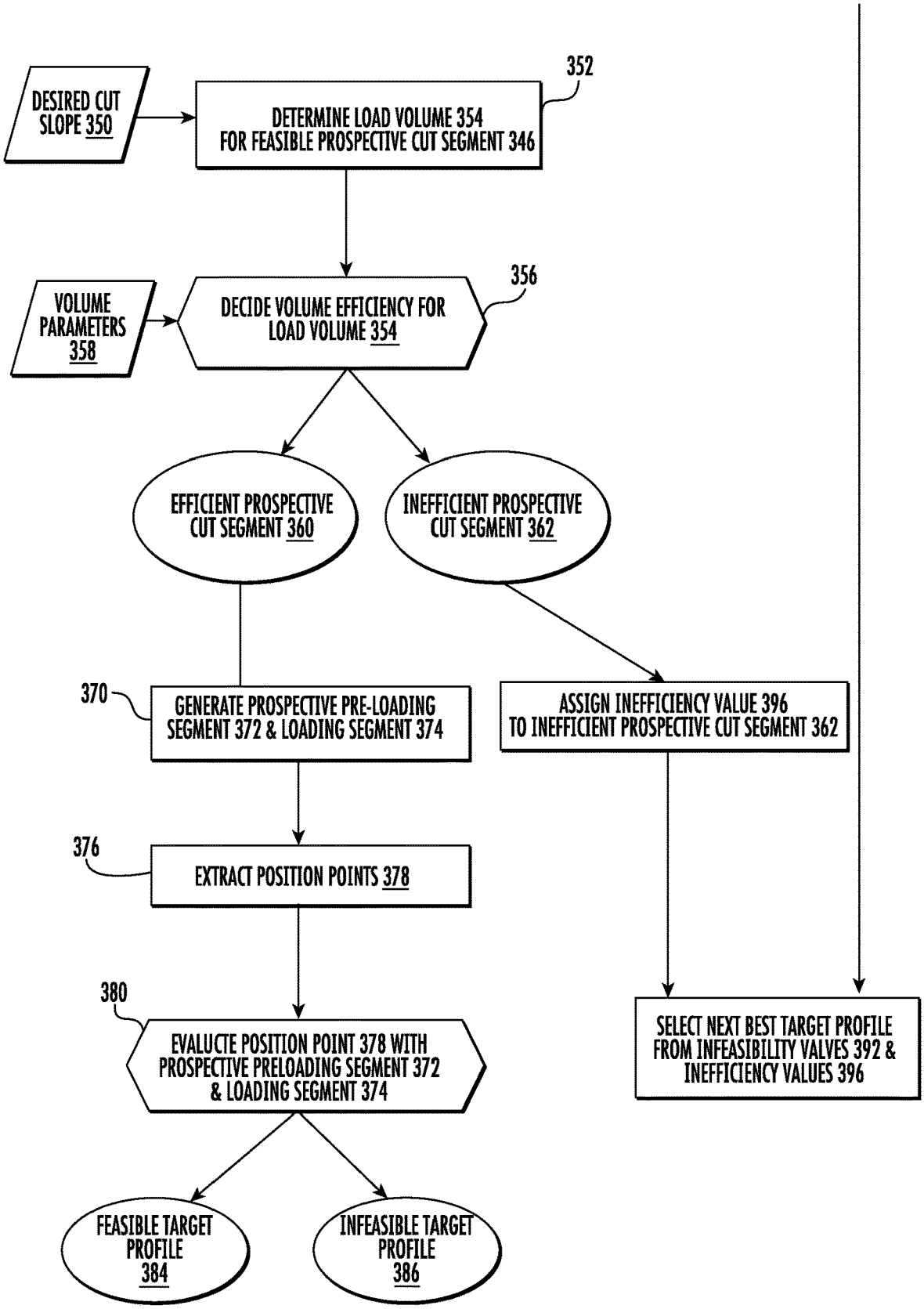

Referring to FIG. 6, there is illustrated an embodiment of a flowchart, representing a possible program, function, application, process, or routine 300 for generating and assessing the feasibility or infeasibility of a plurality of prospective target profiles 302 to select a final target profile 180 for the machine 100. The routine 300 may be embodied as computer interpretable and executable software instructions that may be stored in and retrievable from memory and may be executable by a processor or similar integrated circuitry. The routine 300 receives various inputs and data regarding the machine 100 and the presented topography 200 of the worksite 150 and can process, generate, and output instructions and commands to regulate and assist in the operation of the machine 100 at the worksite 150. The control system 130 associated with the machine 100, whether in the embodiment of an onboard electronic controller, off-board computer system, or combination thereof, may conduct or execute the routine 300.

In a first storage step 304, information and data regarding the presented topography 200 of the worksite 150 may be input and stored as computer processable data. Such information regarding the presented topography 200 may include geographic information 306 such as elevations, grades, and slopes, and may include material data 308 about the material at the worksite such as relative hardness, compactness, density, strata, etc. The information and data about the presented topography 200 and the material data may be represented as a three dimensional, digital map and can be stored in the data storage 134 associated with the machine 100.

In a second storage step 310, machine dimensional data 312 may be input and stored as computer processable data for use by the routine 300. Machine dimensional data 312 can include information about the machine such as machine length 314; implement length 316 of the ground-engaging work implement or blade 110; implement ranges 318 regarding vertical positions of the blade 110 with respect to the frame 102 of the machine 100; pitch ranges 319 regarding the pitch ranges of blade 110 with respect to the machine 100; and other needed dimensional information. In a third storage step 320, machine operational data 322 maybe input and stored as computer processable data for use by the routine 300. Machine operational data 320 can include additional information about the machine 100 such as velocity information 324 regarding the ground speed capabilities of the machine 100; implement adjustment rates 326 regarding the speed or rate with which the blade 110 may be raised, lowered, or its pitch adjusted; load information 328 regarding material load capabilities of the machine 100 based in part on power or torque, and other operational characteristics or limits of the machine 100. The machine dimensional data 312 and the machine operational data 322 can also be stored in the data storage associated with the machine 100.

The routine 300 may be capable of generating and analyzing a plurality of prospective cut segments 340 for the prospective target profiles 302 for conducting part or all of a slot-forming pass 170. The prospective cut segments 340 may be selected at different cut points 178 disposed along the length of the slot 160, which may be randomly or systematically generated. To assess the feasibility of the prospective cut segment 340, the routine 300 in a first determination step 342 may make a current machine position/orientation assessment 343 regarding the position and orientation of the machine 100 with respect to the worksite 150 in general and the cut point 178 of the prospective cut segment 340 in particular. In addition to determining location in terms of coordinates, the current machine position/orientation assessment 343 may also include information about the heading, velocity, and orientation of the machine 100 in terms of pitch, angle, slope, speed, etc.

After making the current machine position/orientation assessment 343, the routine 300 in a first decision step 344 evaluates the feasibility or infeasibility of the machine 100 making a cut 176 in accordance with the prospective cut segment 340. Feasibility can be assessed by comparing and analyzing the presented topography 200 with the current machine position/orientation assessment 343, the machine dimensional data 312, and the machine operational data 322. For example, in an embodiment, the first decision step 344 can process the machine length 314, implement length 316, and implement adjustment rate 326, and possibly other information to decide whether the blade 110 can be appropriately positioned to intersect the cut point 178 associated with the prospective cut segment 340 given the current machine position/orientation assessment 343. In other words, the first decision step 344 confirms whether there exists a potential preloading segment that enables the machine 100 to move longitudinally while adjusting the elevation of the blade 110 vertically to intersect the cut point 178 associated with the prospective cut segment 340. The first decision step 344 results in each prospective cut segment 340 being categorized as one of a feasible prospective cut segment 346 or an infeasible prospective cut segment 348.

To assess the efficiency of the prospective target profiles 302, the routine 300 can assess whether the feasible prospective cut segments 346 can remove or displace a sufficient amount of material to be an efficient use of machine time and fuel. For example, a desired cut slope 350 or plurality of desired cut slopes defining the resulting slope or grade of the cut 176 can be input to the routine 300. The desired cut slope 350 may determine in whole or in part the pitch angle of the blade 110 during the cut 176 and may be considered as the angle of attack of the blade 110 into the material. The desired cut slope 350 may be selected so that the machine 100 will not slip or tip during the prospective cut segment 340. The desired cut slope 350 may be dynamic and can change as the blade 110 penetrates the material during the prospective cut segment 340. Based on the desired cut slope 350, which determines the penetration of the blade 110 into the material, and the pre-stored presented topography, the volume of the material that can be removed or displaced during the feasible prospective cut segment 346 and subsequent material loading of the blade 110 during the prospective target profile 302 can be determined.

Accordingly, in a volume decision 352, the routine 300 can calculate the load volume 354, or a similar value related to the amount of material that the feasible prospective cut segment 346 may remove, in terms of cubic meters, kilograms, or the like. The routine 300, in a volume decision step 356 compares the load volume 354 with a series of predefined volume parameters 358 for the particular machine 100. The volume parameters 358 may relate to the optimal or maximum quantity of material the machine 100 can move or displace and can be based on dimensions of the blade 110, machine torque or power, and similar parameters. The volume parameters 358 may be pre-stored as part of the machine dimensional data 312 or machine operational data 322. The volume decision 352 results in a determination about whether each feasible prospective cut segment 346 is an efficient prospective cut segment 360 or an inefficient prospective cut segment 362.

As stated above, in an embodiment, the routine 300 may also evaluate the preload segment and loading segment of the prospective target profile 302 with respect to whether the machine 100 can adequately execute those segments of the prospective target profile 302. For example, in an embodiment, the routine 300 in a generation step 370 may generate and analyze a prospective preload segment 372 and a prospective loading segment 374 based upon and associated with the efficient prospective cut segment 360. The prospective preload segment 372 and the prospective loading segment 374 may represent the path or course that the blade 110 of the machine 100 should move along to execute the efficient cut segment 360 and produce the prospective target profile 302. The control system 130 may generate the prospective preload segment 372 and prospective loading segment 374 using any suitable technique and/or information about the presented topography 200, machine dimensional data 312, and machine operational data 322.

Once generated, the routine 300 in an extraction step 376 may extract a plurality of position points 378 and further, in an evaluation step 380, may evaluate the position points 378 to determine the feasibility of the prospective preload segment 372 and the prospective loading segment 374. In an embodiment, the position points 378 may represent points along the prospective preload segment 372 and the prospective loading segment 374 which the blade 110 must follow to complete the prospective target profile 302. In other words, the position points 378 represent theoretical targets the blade 110 must align with and follow to execute the prospective target profile 302. By way of example, the position points 378 may be spaced approximately every 20-40 centimeters along the length the prospective preload segment 372 and the prospective loading segment 374.

In an evaluation step 380, the routine 300 may evaluate and decide whether the machine 100 is actually capable of positioning the blade 110 to align with the position points 378 at the necessary times. The evaluation step 380 may utilize the current machine position/orientation assessment 343, the machine dimensional data 312, machine operational data 322, and the presented topography 200 to perform this evaluation. If the machine 100 can align the blade 110 with the position points 378, the result of the evaluation step 380 is that the prospective target profile 302 for the evaluated prospective preload segment 372 and the prospective loading segment 374 is determined to be a feasible target profile 384. Conversely, if the machine 100 cannot align the blade 110 with the position points 178, for example due to kinematic constraints on the machine, the result of the evaluation step 380 is that the prospective target profile 302 for the evaluated prospective preload segment 372 and the prospective loading segment 374 is determined to be an infeasible target profile 386. The feasible target profile 384 may be selected and utilized as the target profile 180 for the making the cuts 176 as the machine 100 completes a pass 170.

The foregoing routine 300 can be executed iteratively for each of the plurality of prospective target profiles 302. If for any reason a prospective target profile 302 is determined to be an infeasible target profile 386, the routine 300 may advance and assess the next prospective target profile 302 of the plurality until a feasible target profile 384 is obtained. The routine 300 may generate a plurality of feasible target profiles 384 for the respective pass 170, and may select the best or optimal as the target profile 180.

In an embodiment, if the routine 300 resolves that all prospective target profiles 302 results in infeasible target profiles 382, the routine 300 can attempt to select and utilize the next best prospective target profile 302. For example, the routine 300 may assign error ratings or values to those results previously determined to be infeasible. By way of a particular example, in a first assignment step 390, an infeasibility value 392 can be assigned to the infeasible prospective cut segments 348 resulting from the first decision step 344. The infeasibility value 392 can be based on or account for the kinematic or locational error representing the amount or degree by which the machine 100 will place the blade 110 in the incorrect position for the prospective cut segment 340. By way of another example, in a second assignment step 394, an inefficiency value 396 can be assigned to the inefficient prospective cut segments 362 resulting from the volume decision 352. The inefficiency value 396 can represent the amount or degree by which the load volume 354 differs from the volume parameters 350 for the machine 100. In a subsequent selection step 398, the infeasibility values 392 and the inefficiency values 396 for each prospective target profile 302 can be compared and evaluated with the one demonstrating the least err or deviation being selected as the target profile 180.

It will be appreciated that the foregoing description provides examples of the disclosed system and technique. However, it is contemplated that other implementations of the disclosure may differ in detail from the foregoing examples. All references to the disclosure or examples thereof are intended to reference the particular example being discussed at that point and are not intended to imply any limitation as to the scope of the disclosure more generally. All language of distinction and disparagement with respect to certain features is intended to indicate a lack of preference for those features, but not to exclude such from the scope of the disclosure entirely unless otherwise indicated.

Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context.

Accordingly, this disclosure includes all modifications and equivalents of the subject matter recited in the claims appended hereto as permitted by applicable law. Moreover, any combination of the above-described elements in all possible variations thereof is encompassed by the disclosure unless otherwise indicated herein or otherwise clearly contradicted by context.

I claim:

1. A system for controlling a machine having a ground-engaging work implement to move material according to a target profile including a preloading segment, a cut segment, and a loading segment, the system comprising:

data storage to store computer processable data related to machine dimensional data, machine operational data, and a presented topography of a worksite;

a position sensing system to determine a current machine position/orientation assessment of the machine at a current position of the machine at the worksite;

a controller configured to generate a feasible target profile by performing in ordered sequence:

deciding feasibility of a prospective cut segment from among a plurality of prospective cut segments based on the current machine position/orientation assessment from the position sensing system of the machine at the current position of the machine at the worksite, as well as the machine dimensional data, the machine operational data, and the presented topography of the worksite as defined prior to performing the prospective cut segment, from the data storage, the deciding the feasibility of the prospective cut segment including determining whether the ground-engaging work implement is able to be appropriately positioned starting from the current position of the machine at the worksite so as to intersect a cut point associated with the prospective cut segment; and only under a condition that the prospective cut segment is decided to be feasible performing the following in ordered sequence:

generating a prospective preload segment and a prospective loading segment associated with the prospective cut segment determined to be feasible;

extracting a plurality of position points associated with the generated prospective loading segment;

deciding feasibility of the generated prospective loading segment by determining whether the ground-engaging work implement will align with the plurality of position points; and determining that the target profile corresponding to the prospective cut segment determined to be feasible is feasible when the deciding the feasibility of the prospective loading segment indicates that the generated prospective loading segment is feasible, wherein the controller is configured to output control signaling to control the machine to move according to the feasible target profile to move the material, and wherein the controller iteratively decides feasibility of each of the plurality of prospective cut segments.

2. The system of claim 1, wherein the controller assigns each of the plurality of prospective cut segments as a feasible prospective cut segment or an infeasible prospective cut segment as a result of deciding feasibility of the prospective cut segment.

3. The system of claim 2, wherein the controller is thither configured to:

calculate a load volume for the prospective cut segment, the load volume indicative of a quantity of material moved by the machine during a pass of the worksite; and assess efficiency of the load volume.

4. The system of claim 3, wherein the controller assigns the load volume as an efficient load volume or as an inefficient load volume based on determining efficiency of the load volume.

5. The system of claim 4, wherein the controller assigns an infeasibility value for each infeasible prospective cut segment and assigns an inefficiency value for each inefficient load volume.

6. The system of claim 5, wherein the controller is further configured to determine a next best prospective target profile based on the infeasibility value and the inefficiency value.

7. The system of claim 3, wherein the load volume is calculated based on volume parameters indicative of an optimal volume of material the machine is to move during the pass of the worksite.

8. The system of claim 7, wherein the load volume is further calculated based on a desired cut slope of the ground-engaging work implement, the desired cut slope indicative of an angle of attack of the ground-engaging work implement during the cut segment.

9. The system of claim 1, wherein the machine dimensional data includes machine length and implement length and the machine operational data include implement adjustment rate.

10. A method of generating a target profile for a machine having a ground-engaging work implement to move material about a worksite, the target profile having a preloading segment, a cut segment, and a loading segment, the method comprising:

storing, in data storage, machine dimensional data related to dimensions of the machine;

storing; in data storage, machine operational data related to operation of the machine;

storing, in data storage, a presented topography of a worksite;

determining, for a current location of the machine at the worksite, a current machine position/orientation assessment of the machine at the worksite using a position sensing system;

deciding, using control circuitry, feasibility of a prospective cut segment from a plurality of prospective cut segments based on the current machine position/orientation assessment from the position sensing system of the machine at the current location of the machine at the worksite, as well as the machine dimensional data, the machine operational data, and the presented topography of the worksite as defined prior to performing the prospective cut segment, from the data storage by determining whether the ground-engaging work implement is able to be positioned starting from the current location of the machine at the worksite to intersect a cut point associated with the prospective cut segment;

only under a condition that said deciding feasibility of the prospective cut segment indicates that the prospective cut segment is feasible, performing the following operations in ordered sequence:

calculating, using the control circuitry, a load volume for the prospective cut segment, the load volume indicative of a quantity of material moved by a pass of the machine at the worksite;

deciding, using the control circuitry, efficiency of the load volume;

generating, using the control circuitry, a prospective preload segment and a prospective loading segment associated with the prospective cut segment determined to be feasible;

extracting, using the control circuitry, a plurality of position points associated with the determined prospective loading segment;

deciding, using the control circuitry, feasibility of the determined prospective loading segment by determining whether the ground-engaging work implement will align with the plurality of position points; and determining, using the control circuitry, that the target profile corresponding to the determined prospective cut segment determined to be feasible is feasible when said deciding feasibility of the prospective loading segment indicates that the generated prospective loading segment is feasible; and controlling, using the control circuitry, the machine to move according to the target profile determined to be feasible to move the material, wherein the target profile determined to be feasible is a most feasible target profile from among a plurality of target profiles determined to be feasible, and wherein the method iteratively decides feasibility of each of the plurality of prospective cut segments.

11. The method of claim 10, wherein the method assigns each of the plurality of prospective cut segments either as a feasible prospective cut segment or as an infeasible prospective cut segment.

12. The method of claim 11, wherein the method assigns the load volume for each of the feasible prospective cut segment as an efficient load volume or as an inefficient load volume based on determining efficiency of the load volume.

13. The method of claim 12, wherein the method:

assigns an infeasibility value to each infeasible prospective cut segment;

assigns an inefficiency value to each inefficient load volume; and determines a next best prospective target profile based on the infeasibility value and the inefficiency value.

14. The method of claim 10, wherein the load volume is further calculated based volume para ers and a desired cut slope of the ground-engaging work implement, the volume parameters indicative of an optimal volume of material the machine is to move during the pass of the worksite, the desired cut slope indicative of an angle of attack of the ground-engaging work implement during the cut segment.

15. A machine comprising:

a prime mover;

a ground-engaging work implement to move material about a worksite;

a position sensing system to determine a current machine position/orientation assessment of the machine at the worksite at a current position of the machine at the worksite;

data storage to store computer processable data related to machine dimensional data, machine operational data, and a presented topography of the worksite;

a controller configured to generate a feasible target profile by performing in ordered sequence:

deciding feasibility of a prospective cut segment from among a plurality of prospective cut segments based on the current machine position/orientation assessment from the position sensing system of the machine at the current position of the machine at the worksite, as well as machine dimensional data, the machine operational data, and the presented topography of the worksite as defined prior to performing the prospective cut segment, from the data storage, the deciding the feasibility of the prospective cut segment including determining whether the ground-engaging work implement is able to be appropriately positioned starting from the current position of the machine at the worksite so as to intersect a cut point associated with the prospective cut segment; and only under a condition that the prospective cut segment is decided to be feasible performing the following operations in ordered sequence:

calculating a load volume for the prospective cut segment, the load volume indicative of a quantity of material to be moved by the machine during the feasible target profile;

deciding efficiency of the calculated load volume;

generating a prospective preload segment and a prospective loading segment associated with the prospective cut segment determined to be feasible;

extracting a plurality of position points associated with the determined prospective loading segment;

deciding feasibility of the generated prospective loading segment by determining whether the ground-engaging work implement will align with the position points; and determining that the target profile corresponding to the prospective cut segment determined to be feasible is feasible when the deciding the feasibility of the prospective loading segment indicates that the generated prospective loading segment is feasible, wherein the controller is configured to output control signaling to control the machine to move according to the feasible target profile to move the material, wherein the feasible target profile is a most feasible target profile from among a plurality of target profiles determined to be feasible, and wherein the controller iteratively decides feasibility of each of the plurality of prospective cut segments to obtain the most feasible target profile.

16. The machine of claim 15, wherein the controller is further configured to:

assign each of the plurality of prospective cut segments either as a feasible prospective cut segment or as an infeasible prospective cut segment and to assign each infeasible prospective cut segment an infeasibility value;

assign each inefficient load volume either as an efficient load volume or as an inefficient load volume and to assign each inefficient load volume an inefficiency value; and determine a next best prospective target profile based on the infeasibility value and the inefficiency value.

17. The machine of claim 15, wherein the ground-engaging work implement is a blade pivotally connected to the machine.

* * * * *